US006873817B2

(12) United States Patent
Park et al.

(10) Patent No.: US 6,873,817 B2
(45) Date of Patent: Mar. 29, 2005

(54) ELECTROSTATIC TRANSFER TYPE LIQUID ELECTROPHOTOGRAPHIC PRINTER

(75) Inventors: Moon-bae Park, Gyeonggi-do (KR); Kwang-ho No, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/188,857

(22) Filed: Jul. 5, 2002

(65) Prior Publication Data

US 2003/0161667 A1 Aug. 28, 2003

(30) Foreign Application Priority Data

Feb. 27, 2002 (KR) ..... 2002-10467

(51) Int. Cl.[7] ..... G03G 15/01; G03G 15/16
(52) U.S. Cl. ..... 399/302; 399/66
(58) Field of Search ..... 399/66, 179, 298, 399/299, 302, 303, 305, 313, 316, 317, 318

(56) References Cited

U.S. PATENT DOCUMENTS 6,324,374 B1 * 11/2001 Sasamoto et al. ..... 399/298

FOREIGN PATENT DOCUMENTS

JP 2002-14516 1/2002

* cited by examiner

*Primary Examiner*—Hoang Ngo
(74) *Attorney, Agent, or Firm*—Staas & Halsey LLP

(57) ABSTRACT

In an electrostatic transfer type liquid electrophotographic printer, an applied pressure between each photosensitive drum and a first transfer roller corresponding to the photosensitive drum is reduced along a downstream of a traveling direction of a transfer belt to prevent the deterioration of a toner image generating due to the amount of a liquid carrier sequentially increased when toner image on the photosensitive drum for each color are transferred and overlapped onto the transfer belt.

11 Claims, 3 Drawing Sheets

ELECTROSTATIC TRANSFER TYPE LIQUID ELECTROPHOTOGRAPHIC PRINTER

CROSS-REFERENCE TO RELATED APPLICATIONS

This application claims the benefit of Korean Application No. 2002-10467, filed Feb. 27, 2002, in the Korean Industrial Property Office, the disclosure of which is incorporated herein by reference.

BACKGROUND OF THE INVENTION

1. Field of the Invention

The present invention relates to an electrostatic transfer type liquid electrophotographic printer, and more particularly, to an electrostatic transfer type liquid electrophotographic printer preventing images from deteriorating due to an increase of a liquid carrier on a transfer belt when the images are transferred from the photosensitive drums and overlapped onto the transfer belt.

2. Description of the Related Art

In general, an electrophotographic printer, such as a laser printer, is an image forming apparatus in which a latent electrostatic image is formed on a photosensitive medium, such as a photosensitive drum or photosensitive belt. The latent electrostatic image is developed using toner with a predetermined color, the developed image is transferred onto paper, and thereby a desired image is obtained.

The electrophotographic printer is classified into a liquid electrophotographic printer and a dry-type electrophotographic printer according to the kind of toner. Ink in which toner particles are mixed with a liquid carrier to a predetermined concentration is used in the liquid electrophotographic printer. The liquid electrophotographic printer using the liquid ink has a printing quality better than that of the dry-type electrophotographic printer using toner having powder particles and can easily form a color image.

FIG. 1 is a schematic diagram of a conventional electrostatic transfer type liquid electrophotographic printer. Referring to FIG. 1, the electrostatic transfer type liquid electrophotographic printer includes image forming units 10 developing an image with a predetermined color on photosensitive drums 12, a transfer belt 20 onto which the developed color image is transferred, a first transfer roller 30, and a second transfer roller 40 transferring the transferred color image on paper P.

The transfer belt 20 rotates to contact a roller 22, a transfer backup roller 24, and guide rollers 26 and 28.

The image forming unit 10 includes a main charger 14 charging a surface of the photosensitive drum 12 to a predetermined potential, a laser scanning unit 16 projecting light onto the surface of the charged photosensitive drum 12 and forming a latent electrostatic image, and a developing unit 18 developing the latent electrostatic image to a toner image using ink with a predetermined color.

In order to transfer the toner image developed on the surface of the photosensitive drum 12 onto the transfer belt 20, the first transfer roller 30 to which a voltage having an opposite polarity to that of the toner is applied, is installed. This transfer belt 20 moves between the first transfer roller 30 and the photosensitive drum 12. And this first transfer roller 30 applies a predetermined pressure to the photosensitive drum 12 and the transfer belt 20.

Four sets of the image forming unit 10 and the first transfer roller 30 corresponding to the image forming unit 10 are provided and are arranged in series in a traveling direction of the transfer belt 20 so that images with colors such as yellow (Y), magenta (M), cyan (C), and black (K), are sequentially formed.

The second transfer roller 40 is installed to correspond to the transfer backup roller 24, and a voltage having a polarity opposite to that of the toner is supplied to the second transfer roller 40 so that color images formed on the transfer belt 20 are transferred by an electrostatic force onto the paper P transferred between the transfer backup roller 24 and the second transfer roller 40. This second transfer roller 40 is disposed in a downstream of the traveling direction of the transfer belt 20 from the image forming units 10 and the first transfer backup rollers 30.

In general, a concentration of the toner image formed on a first photosensitive drum 12 when the developed color images are sequentially transferred onto the transfer belt 20 from the photosensitive drums 12, is about 20%, and the liquid carrier is partially squeezed when about 4 kgf of pressure is applied to the transfer belt 20, and thereby the concentration of the toner image is increased slightly. Subsequently, when the toner image on a second photosensitive drum 12 is transferred and overlapped onto the transfer belt 20, the concentration of the toner image at an overlapped and transferred portion is maintained about 20%. However, as an amount of the liquid carrier per area is increased during transferring the image, the images may be pulled out (dragged), and edges of the images may be spread out (blotted) and overlapped. When the transferring of the image is repeatedly performed, the transferred images may severely deteriorate.

SUMMARY OF THE INVENTION

To solve the above and other problems, it is an object of the present invention to provide an apparatus capable of preventing a transferred image from deteriorating by controlling a pressure exerted onto a transfer belt from a first transfer backup roller when a developed image is transferred from a photosensitive drum to the transfer belt.

Additional objects and advantages of the invention will be set forth in part in the description which follows and, in part, will be obvious from the description, or may be learned by practice of the invention.

Accordingly, to achieve the above and other objects, there is provided an electrostatic transfer type liquid electrophotographic printer including a transfer belt which circulates a continuous path and has a transfer side and a rear side opposite to the transfer side, a plurality of rollers which support the transfer belt at the rear side of the transfer belt and guide the circulation of the transfer belt, a plurality of first transfer rollers which are installed consecutively at a predetermined interval to contact the rear side of the transfer belt between the two rollers, a plurality of photosensitive drums which are installed to contact the transfer side of the transfer belt to correspond to the first transfer rollers, and a plurality of image forming units forming a toner image on each photosensitive drum.

A pressure applied between each photosensitive drum and the first transfer roller corresponding to the photosensitive drum is gradually reduced in a downstream of a traveling direction of the transfer belt.

The electrostatic transfer type liquid electrophotographic printer further includes an elastic unit in which the applied pressure from the first transfer roller to the transfer belt is gradually reduced in the downstream of the traveling direction of the transfer belt.

The elastic unit is a compression spring that pushes an element connected to both ends of a shaft of the first transfer roller toward the transfer belt.

The electrostatic transfer type liquid electrophotographic printer further includes a power source supplying a voltage having the same polarity same as that of the toner to the toner image so as to prevent the toner image formed by the image forming unit on the photosensitive drum from being scattered, or further includes an exposing unit which exposes the toner image formed by the image forming unit on the photosensitive drum so that the toner image is easily transferred onto the transfer belt.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
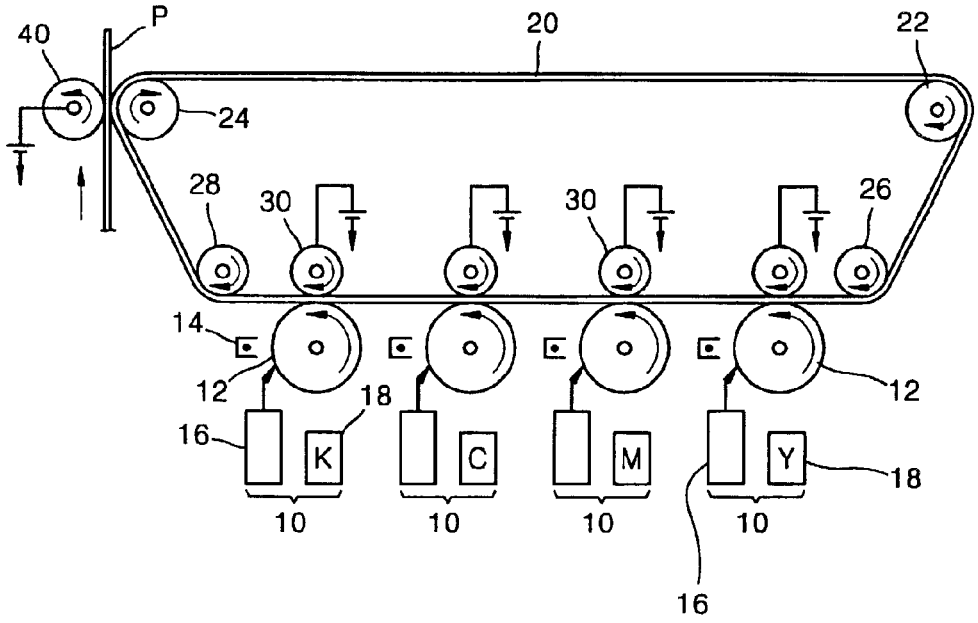
FIG. 1 (PRIOR ART)
FIG. 1 a sectional view of a conventional electrostatic transfer type liquid electrophotographic printer.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

The embodiment of the present invention will be described in detail with reference to the accompanying drawings.

Figure 2:
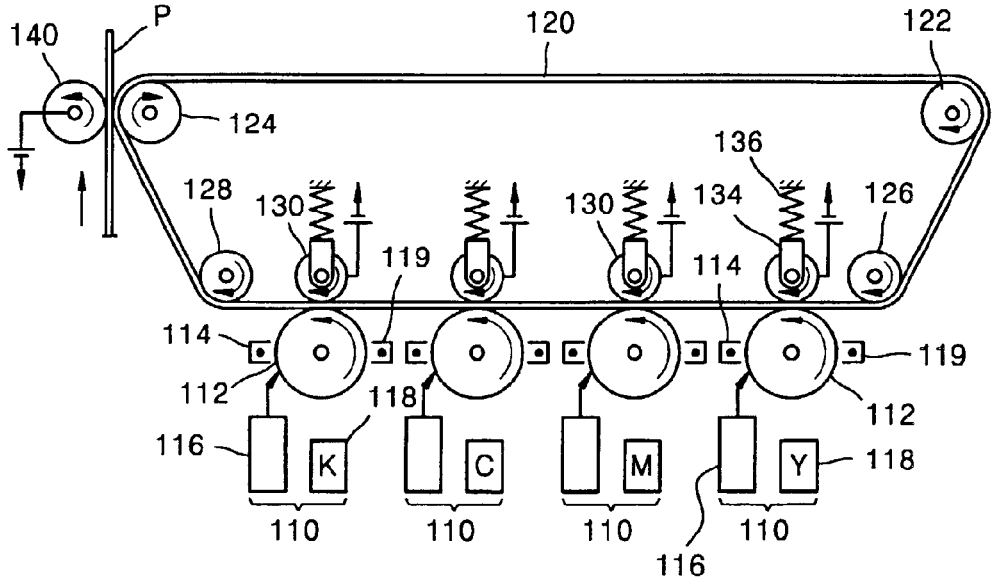
FIG. 2 is a sectional view of an electrostatic transfer type liquid electrophotographic printer according to an embodiment of the present invention.

FIG. 2 is a schematic diagram of an electrostatic transfer type liquid electrophotographic printer according to an embodiment of the present invention. Referring to FIG. 2, the electrostatic transfer type liquid electrophotographic printer includes an image forming unit 110 developing an image with a predetermined color on a photosensitive drum 112, a transfer belt 120 onto which the developed color image is transferred, a first transfer roller 130, and a second transfer roller 140 transferring the transferred color image onto the transfer belt 120 on a paper P.

The transfer belt 120 rotates and contacts a roller 122, a transfer backup roller 124, and guide rollers 126 and 128. The second transfer roller 140 rotates to correspond to the transfer backup roller 124, and between the second transfer roller 140 and the transfer backup roller 124, paper P is transferred.

The image forming unit 110 includes a main charger 114 charging a surface of the photosensitive drum 112 to a predetermined potential, a laser scanning unit (LSU) 116 projecting light onto the surface of the charged photosensitive drum 112 and forming a latent electrostatic image, a developing unit 118 developing the latent electrostatic image to a toner image using ink with the predetermined color, and an auxiliary charger 119 supplying a first voltage of the same polarity as that of toner to the developed toner image. The toner may be charged positive or negative but hereinafter, only the negatively charged toner will be described.

In order to transfer the toner image developed on the surface of the photosensitive drum 112 onto the transfer belt 120, the first transfer roller 130 to which a second voltage having an opposite polarity to that of the toner, i.e., 0.7–2.0 kV, is supplied, is installed. This transfer belt 120 is disposed between the first transfer backup roller 130 and the photosensitive drum 112. And this first transfer roller 130 applies a predetermined pressure to the photosensitive drum 112 and the transfer belt 120.

Four pairs of the image forming unit 110 and the first transfer roller 130 corresponding to the image forming unit 110 are provided and are arranged in series in a traveling direction of the transfer belt 120 so that images with colors such as yellow (Y), magenta (M), cyan (C), and black (K), are formed.

The second transfer roller 140 is installed to correspond to the transfer backup roller 124 and is supplied with a third voltage having a polarity opposite to that of the toner so that the color images formed on the transfer belt 120 are transferred by an electrostatic force onto the paper P supplied between the transfer backup roller 124 and the second transfer roller 140. This second transfer roller 140 is disposed in a downstream in the traveling direction of the transfer belt 120 from the image forming unit 110 and the first transfer backup roller 130.

A developing unit 118 developing a toner image with a yellow (Y) color (hereinafter, referred to as "Y" developing unit) will be described below. When the LSU 116 radiates light onto the surface of the photosensitive drum 112 charged with the predetermined potential through the main charger 114, toner particles mixed with a liquid carrier are attached to the latent electrostatic image formed on the surface of the photosensitive drum 112, and thereby the latent electrostatic image is developed to a toner image.

Subsequently, when the first voltage having the same voltage as or slightly lower than that of the main charger 114 and having the same polarity as that of the main charger 114 is supplied onto the photosensitive drum 112 through the auxiliary charger 119, a first potential in a non-image region does not vary, but a second potential of the toner image in an image region is increased by a second predetermined potential. As a result, the toner image is attached firmly onto the photosensitive drum 112, and the toner image is in good order and prevented from being deformed or smearing when the developed toner image is transferred onto the transfer belt 120.

The toner image developed on the photosensitive drum 112 is transferred onto the transfer belt 120 at a transfer nip having a predetermined width formed between the transfer belt 120 and the photosensitive drum 112 by an electric field formed by the first transfer roller 130 to which the second voltage having a polarity opposite to that of the toner is supplied, and by a pressure of about 4 kgf which is applied to the transfer belt 120 and the photosensitive drum 112 from the first transfer roller 130. In this case, a concentration of the toner image on the photosensitive drum 112 is about 20 wt. %, and the concentration of the toner image transferred onto the transfer belt 120 is increased to about 22–25 wt. %, because the liquid carrier is squeezed due to the pressure of the first transfer roller 130. After the toner image with the yellow (Y) color on the photosensitive drum 112 is transferred onto the transfer belt 120, another toner image with a magenta (M) color is transferred and overlapped onto the transfer belt 20. In this case, the concentration of the toner image in an overlapped region is maintained about 20–25 wt. %, which is similar to that in a non-overlapped region, but the amount of the liquid carrier per area is increased, and thus, images may be pulled out, and the edges of the images may be spread out when the applied pressure from the first transfer roller 130 to the transfer belt 120 and the photosensitive drum 112 is maintained to 4 kgf, and thus the applied pressure from the first transfer roller 130 is reduced to 3 kgf. Subsequently, the toner images with cyan (C) and black (K) colors on the photosensitive drum 112, respectively, are overlapped onto the transfer belt 120, and the applied pressure from the first transfer roller 130 is reduced sequentially to 2 kgf and 1 kgf, respectively, and thereby the transferred toner image is prevented from deteriorating.

Figure 3:
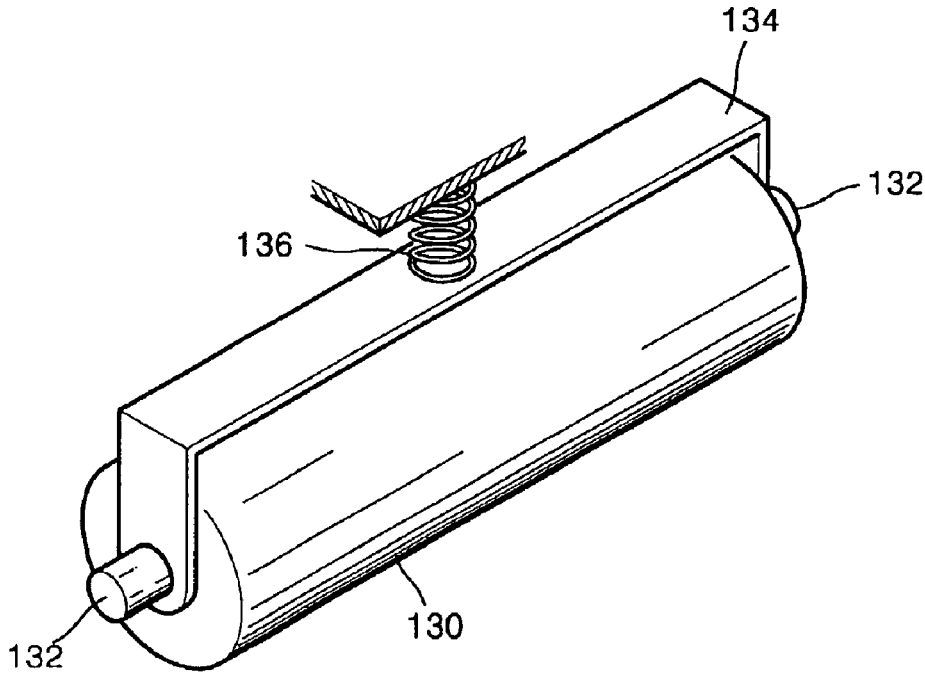
FIG. 3 illustrates a pressing unit elastically pushing a first transfer backup roller against a transfer belt of FIG. 2.

FIG. 3 is an example of a pressing unit of the first transfer roller 130 according to another embodiment of the present invention. Referring to FIG. 3, the first transfer roller 130 rotates with respect to a shaft 132, which is a central axis of the first transfer roller 130, and both ends of the shaft 132 are connected to a compression spring 136, which is an elastic unit, through a connection element 134. The applied pressure to the transfer belt 120 from the first transfer backup roller 130 can be controlled by controlling an elastic force of the compression spring 136.

Complete color images that are formed on the transfer belt 120 are transferred onto the paper P, which passes between the transfer backup roller 124 and the second transfer roller 140, by an electrostatic force and a pushing force from the second transfer roller 140 to the transfer backup roller 124. This electrostatic force is originated from a potential difference of about 1.5~4.0 kV between the transfer backup roller 124 and the second transfer roller 140 which is supplied with the third voltage having a polarity opposite to that of the toner.

In the present embodiment, the auxiliary charger 119 is used to allow the toner image to be easily transferred, but an eraser (not shown), which is an exposing unit, instead of the auxiliary charger 119, may be installed. When the eraser is installed between the developing unit 118 and the transfer nip in a rotating direction of the photosensitive drum 12, and when the photosensitive drum 112 is exposed to light of the eraser, the toner is not affected by this light, but the toner of the non-image region is affected, and thereby the potential of the non-image region is reduced. Thus, some current of the first transfer roller 130 flows into the toner, and thereby the toner image is easily transferred onto the transfer belt 120.

As described above, in the electrostatic transfer type liquid electrophotographic printer according to the present invention, the applied pressure from the first transfer backup roller to the transfer belt is controlled, and thereby the toner image is prevented from deteriorating during a transfer operation.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An electrostatic transfer type liquid electrophotographic printer comprising:

a transfer belt circulating a continuous path in a traveling direction and having a transfer side and a rear side opposite to the transfer side;

a plurality of rollers supporting the transfer belt at the rear side of the transfer belt and guiding the circulation of the transfer belt;

a plurality of first transfer rollers which are installed consecutively at a predetermined interval to contact the rear side of the transfer belt between the rollers;

a plurality of photosensitive drums which are installed to contact the transfer side of the transfer belt to correspond to the first transfer rollers; and a plurality of image forming units forming a toner image on each photosensitive drum, wherein respective pressures between the photosensitive drums and the first transfer rollers corresponding to the respective photosensitive drums are gradually reduced along a downstream of the traveling direction of the transfer belt.

2. The electrostatic transfer type liquid electrophotographic printer of claim 1, further comprising:

an elastic unit in which the respective pressures to be transmitted from the first transfer rollers to the transfer belt are gradually reduced along the downstream of the traveling direction of the transfer belt.

3. The electrostatic transfer type liquid electrophotographic printer of claim 2, wherein the elastic unit comprises:

a shaft of the first transfer roller;

an element coupled to the shaft; and a compression spring pushing the element of the first transfer roller toward the transfer belt.

4. The electrostatic transfer type liquid electrophotographic printer of claim 1, further comprising:

a power source supplying a voltage having the same polarity as that of the toner to the toner image so as to prevent the toner image formed by the image forming unit on the photosensitive drum from being scattered.

5. The electrostatic transfer type liquid electrophotographic printer of claim 4, wherein the power source is a charger.

6. The electrostatic transfer type liquid electrophotographic printer of claim 1, further comprising:

an exposing unit exposing the toner image formed by the image forming units on the respective photosensitive drums so that the toner image is easily transferred onto the transfer belt.

7. The electrostatic transfer type liquid electrophotographic printer of claim 6, wherein the exposing unit is an eraser.

8. An electrophotographic printer having a transfer belt and first, second, third, and fourth photosensitive drums contacting a transfer side of the transfer belt to transfer respective images to the transfer side of the transfer belt, comprising:

first, second, third, and fourth transfer rollers contacting a rear side of the transfer belt to support and push the transfer belt against the corresponding ones of the first, second, third, and fourth photosensitive drums with first, second, third, and fourth pressures, respectively, wherein the first, second, third, and forth pressures are an elastic force.

9. The printer of claim 8, wherein the first, second, third, and fourth pressures are different from each other.

10. The printer of claim 8, wherein the first pressure is greater than the second, third and fourth pressures.

11. An electrophotographic printer having a transfer belt and first, second, third, and fourth photosensitive drums contacting a transfer side of the transfer belt to transfer respective images to the transfer side of the transfer belt, comprising:

first, second, third, and fourth transfer rollers contacting a rear side of the transfer belt to support and push the transfer belt against the corresponding ones of the first, second, third, and fourth photosensitive drums with first, second, third, and fourth pressures, respectively, wherein the transfer belt travels in a traveling direction between the photosensitive drums and the transfer rollers, and the first photosensitive drum and the first transfer roller, the second photosensitive drum and the second transfer roller, the third photosensitive drum and the third transfer roller, and the fourth photosensitive drum and the fourth transfer roller are disposed along the traveling direction of the transfer belt in order, the first transfer roller disposed on an upstream of the traveling direction of the transfer belt to push the transfer belt against the first photosensitive drum with the first pressure greater than that of the fourth transfer roller disposed on an downstream of the traveling direction of the belt.

* * * * *